US005158003A

United States Patent [19]

Lee

[11] Patent Number: 5,158,003

[45] Date of Patent: Oct. 27, 1992

[54] KEYS FOR ELECTRONIC MUSICAL INSTRUMENT

[75] Inventor: Ho Jin Lee, Seoul, Rep. of Korea

[73] Assignee: Samick Musical Instruments Mfg. Co. Ltd., Ichon, Rep. of Korea

[21] Appl. No.: 585,304

[22] Filed: Sep. 19, 1990

[30] Foreign Application Priority Data

Jul. 31, 1990 [KR] Rep. of Korea ..... 1990/11661

[51] Int. Cl.[5] ..... G10C 3/12

[52] U.S. Cl. ..... 84/439; 84/644

[58] Field of Search ..... 84/439, 433, 440, 720, 84/744, 745, 644, 670; 200/512, 513

[56] References Cited

U.S. PATENT DOCUMENTS 4,512,234 4/1985 Kumano ..... 84/433
4,775,574 10/1988 Fukushima et al. ..... 84/DIG. 7 X
4,890,533 1/1990 Katsuta et al. ..... 84/439

*Primary Examiner*—L. T. Hix
*Assistant Examiner*—Howard B. Blankenship
*Attorney, Agent, or Firm*—Price, Heneveld, Cooper DeWitt & Litton

[57] ABSTRACT

Keys for an electronic musical instrument which is capable of giving an after-touch effect is disclosed. If a key is pressed, the point contact rubber is also pressed to point-contact-operate the circuit board, and at the same time, the point contact pin of the key is contacted with the point contact rubber, so that its contact with the circuit board should be transmitted to the hand of the player in the form of an after-touch effect.

18 Claims, 6 Drawing Sheets

KEYS FOR ELECTRONIC MUSICAL INSTRUMENT

FIELD OF THE INVENTION

The present invention relates to keys for an electronic musical instrument, which is capable of providing an after-touch effect such that, upon pressing a key, the player feels as if the key is engaged with something and is released immediately. That is, if a key is pressed, the point contact rubber is also pressed to point-contact-operate the circuit board, and at the same time, the point contact pin of the key is contacted with the point contact rubber, so that contact with the circuit board should be transmitted to the hand of the player, such an after-touch effect being unseen in the conventional electronic musical instruments.

BACKGROUND OF THE INVENTION

The generally used grand /piano or upright piano gives a touch effect or a connection effect which is produced when the pressed key is engaged with something and is released immediately after descending 7–7.5 mm. However, all the electronic /musical instruments which have been used so far did not give such an after-touch effect, and therefore, players of electronic musical instruments could not feel such an after-touch effect, with the result that the players felt confusions and other difficulties. Therefore, there have been brisk activities among the concerned corporations and private researches in order to develop an electronic musical instrument which is capable of giving some effect which is similar to the after-touch effect. As a result of such efforts, a number of patent applications have been filed, but only a few of them have been put to practical uses. However, these which have been put to practical uses are far from giving the exact after-touch effect which is seen in the non-electronic usual pianos.

SUMMARY OF THE INVENTION

The present invention is intended to overcome the above described disadvantages of the conventional electronic musical instruments. Therefore it is the object of the present invention to provide keys of an electronic musical instrument, which is capable of giving an acceptable after-touch effect, so that the player of a piano should be protected from the confusion which is encountered in the conventional electronic musical instruments.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
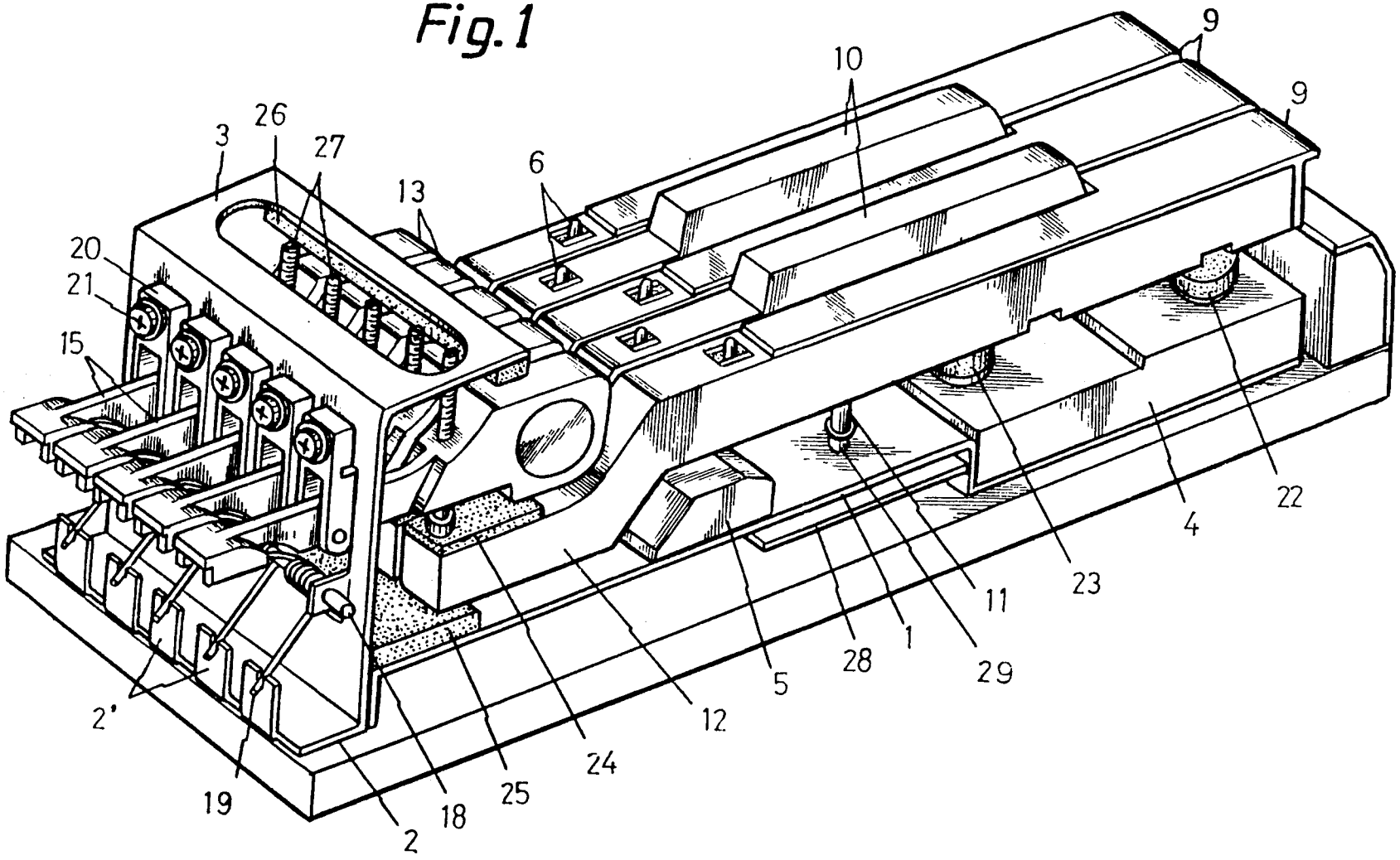
FIG. 1 is a perspective view of the critical portion of the device of the present invention.
Figure 2:
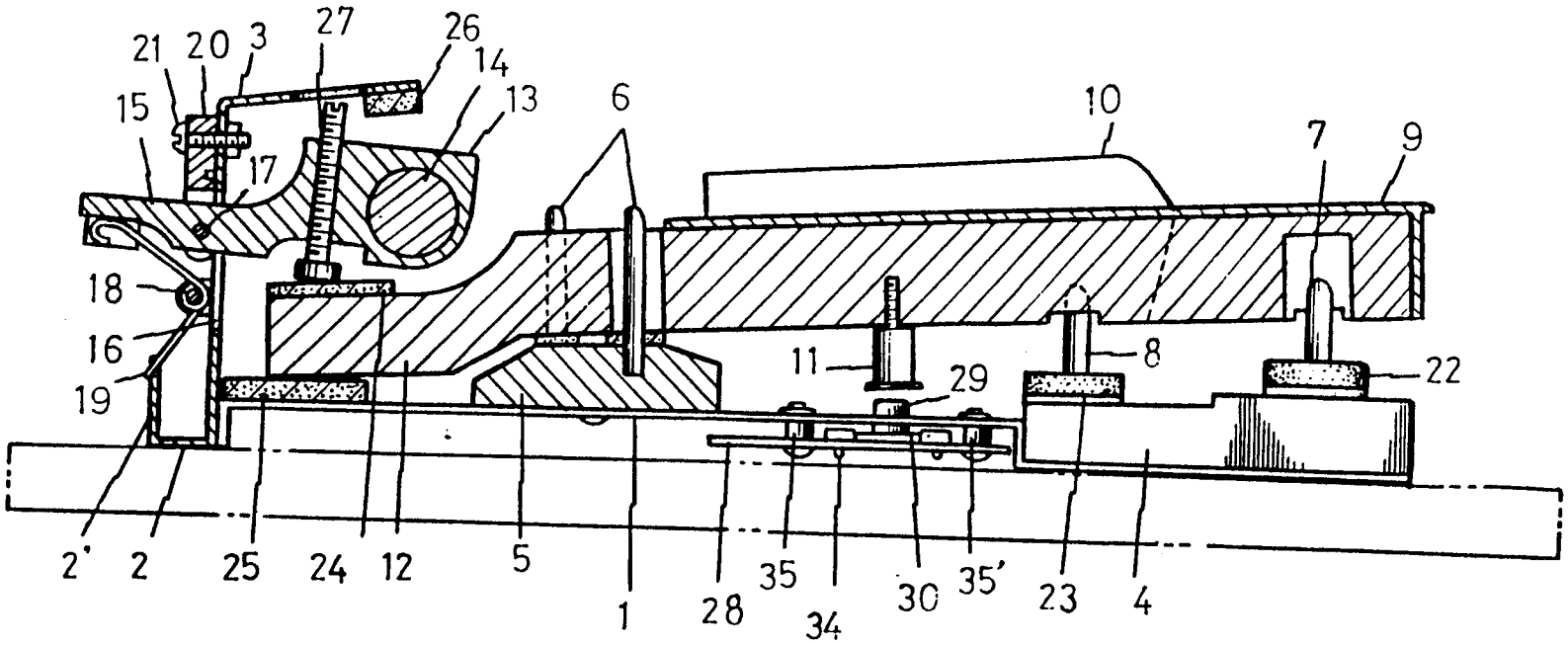
FIG. 2 is a lateral sectional view of the device of the present invention.

A support plank 4 and a balance rail 5 are secured on a metal key chassis 1 and on a back metal key chassis 2, while a bending piece 2' and a panel wainscot 3 are integrally provided on the back metal key chassis 2 in an upright form. A balance pin 6 and front and back pins 7,8 are also provided in an upright form on the support plank 4 and on a balance rail 5, and a white key 9 and a black key 10 are fitted to the balance pin 6, in such a manner that the front pin 7 should support the white key 9 and the back pin 8 should support the black key 10. Point contact pins 11 are secured to the lower portions of the keys 9,10, /and above the rear end portions 12 of the respective keys, there is provided a hammer beam 15 which is integrally provided with a hammer 13 having a hammer weight 14, and which passes through a guide hole 16 formed on the panel wainscot 3. After passing through the guide hole 16, the hammer beam 15 is pivotally secured to a hammer guide 20 by means of a centre pin 17, the hammer guide 20 being secured to the back side of the panel wainscot 3 by means of a bolt 21.

A hammer spring 19 is fitted to a spring shaft 18 which is installed below the guide hole 16 of the panel wainscot 3 in an elongate form, in such a manner that one end, or one arm, of the hammer spring 19 should support the /bending piece 2' and the other end, on an other of spring 19 should support the hammer beam 15. Weight balance machine screws 27 are installed to the respective hammers 13 so as for them to be balanced, while a plurality of point contact rubber 29 are fitted respectively into a plurality of holes which are formed below the point contact pins 11. Into holes 26' of a circuit board 28, there are fitted a plurality of /insertion protuberances 34 of the point contact rubber 29 which is integrally formed with a first contact portion 32, a second contact portion 33, a /bending portion 31 and a connection rubber plate 30, thereby securing the circuit board 28 to the metal key chassis 1 by means of securing pins 35,35'.

The device of the present invention constituted as above will now be described as to its function and effect.

Figure 3:
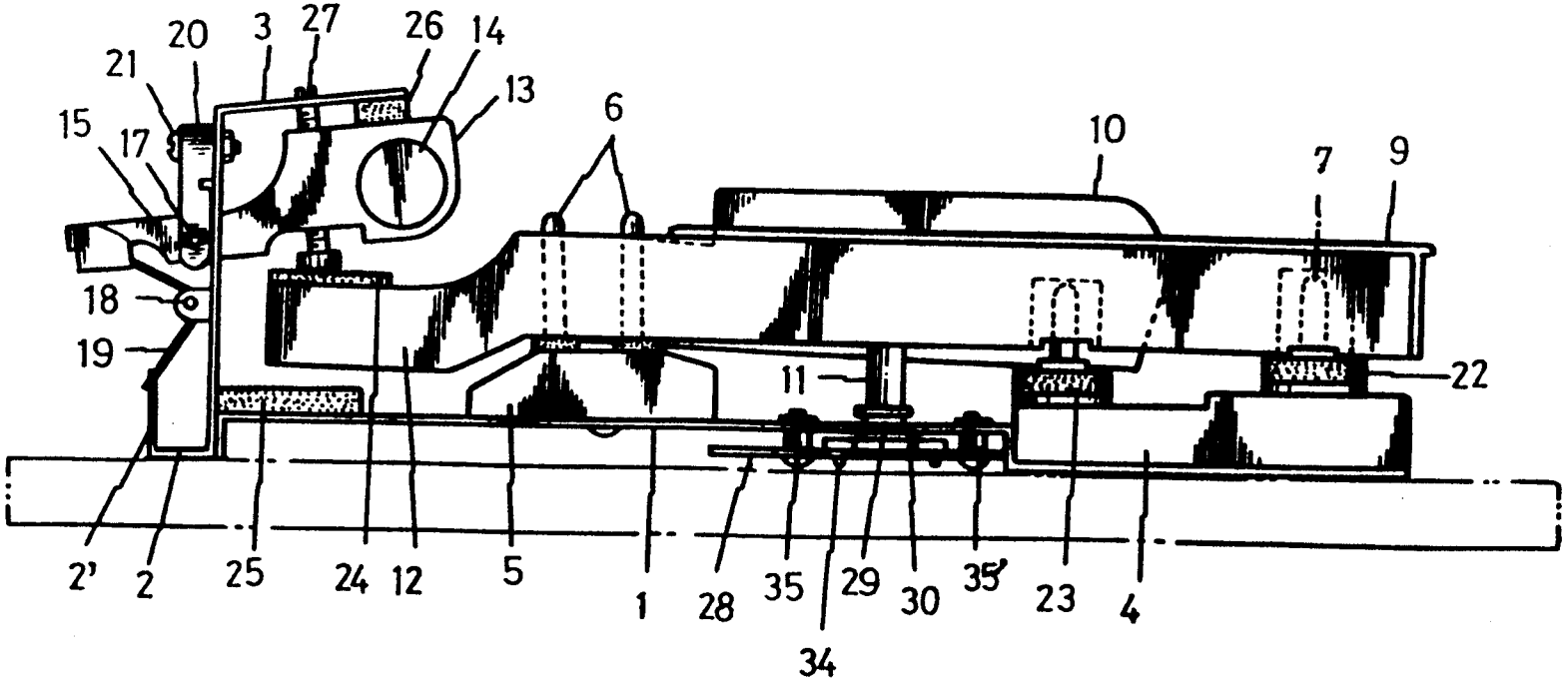
FIG. 3 is a side view of the /device of the present invention, showing the operation thereof.
Figure 4:
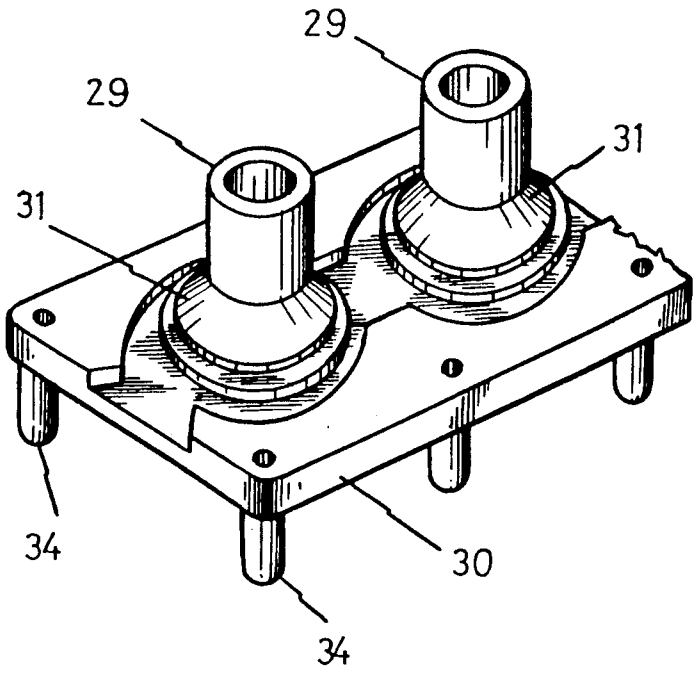
FIG. 4 is a perspective view of the point contact rubber according to the present invention.

If a player presses the white keys 9 and the black keys 10, they are actuated across the balance pin 6 of the balance rail 5 as shown in FIG. 3. That is, the keys 9,10 transmit pivoting motions to the weight balance machine screw 27 which is inserted into the hammer 13, the pivoting motion being made around the centre pin 17. As a result, the hammer 13 is lifted up together with the weight balance machine screw 27, and when the hammer 13 transmits the pivoting motion, a twisting (compressing) force is transmitted to the hammer spring 19 which is /supported elastically on the hammer 15, while, at the same time, the point contact pin 11 which is inserted into the lower portion of the white or black key 9 or 10 presses the point contact rubber 29 which is attached on the circuit board 28.

Thus, upon pressing of the point contact rubber 29 by the point contact pin 11, the first contact portion 32 /in the form of a conductive rubber ring is lightly contacted on the circuit board 28, and immediately, the second contact portion /33 made of a conductive rubber is contacted to the circuit board 28 so as for a musical sound to be produced, with the result that the contacts of the first and second contact portions 32,33 to the circuit board 28 are transmitted to the hands of the player as /an after-touch effect. That is, a touch feeling that something is engaged is passed to the hands of the player, and this is done simultaneously with the generation of the musical sound.

Figure 5:
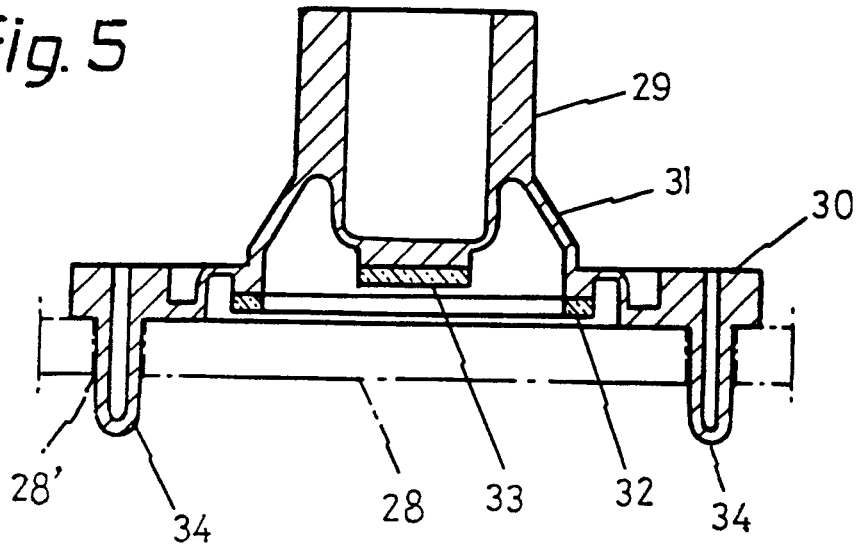
FIG. 5 is an enlarged sectional view of /the point contact of the rubber according to the present invention.
Figure 6:
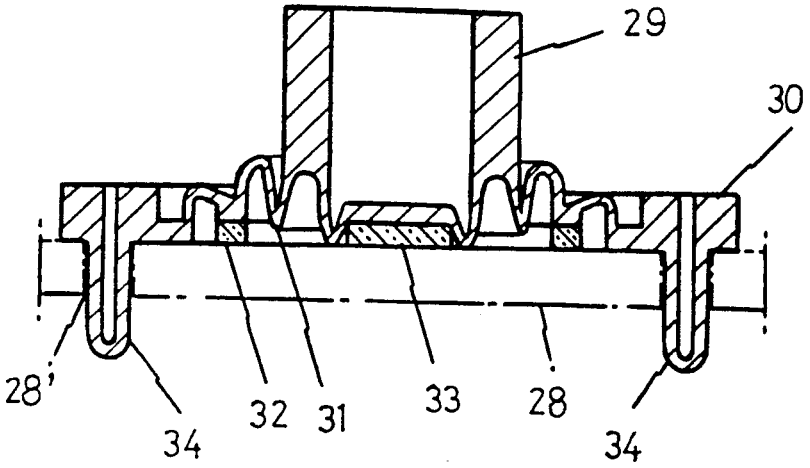
FIG. 6 is an enlarged sectional view /examplarily showing the operation of the point contact rubber according to the present invention.

If the pressed white or /black key 9 or 10 is released, then, the restoring force of the compressed hammer spring together with that of the hammer weight 14 of the hammer 13 is transmitted to the weight balance machine screw 27. As a result, the weight balance machine screw 27 presses the rear end portion of the key 9 or 10, so that the point contact pin 11 should be detached from the point contact rubber 29, and that the point contact rubber 29 should be speedily restored to the original position because the point contact rubber 29 is made of a silicone rubber. That is, the point contact rubber 29 is restored from the state of FIG. 6 to the state of FIG. 5. When the point contact pin 11 presses, the point contact rubber 29 is bent at its bending portion 31, and /at the same time, the first and second contact portions 32,33 are successively contacted to the circuit board 28. At the moment of the contaction, the musical sound is generated and a touch effect is produced, in such a manner that, if the second contact portion 33 is contacted more speedily, the generated sound becomes bigger, while if the contacting speed is slow, the generated sound is small.

Figure 7:
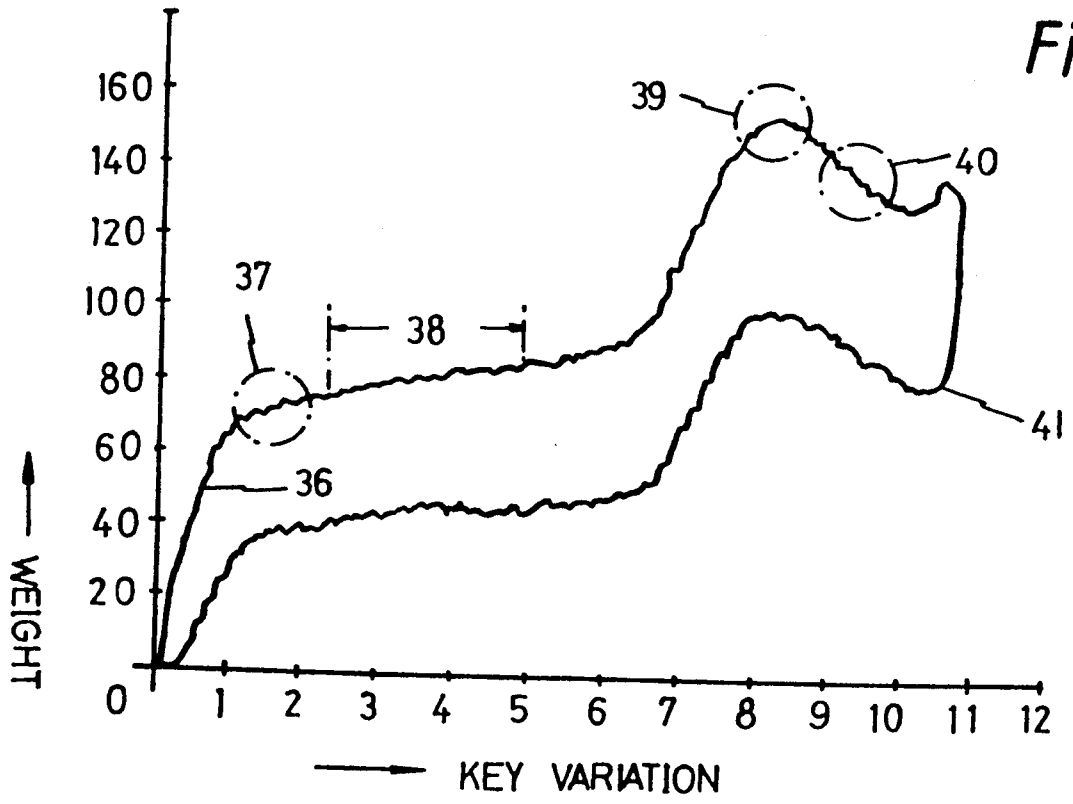
FIG. 7 is a graphical illustration of the characteristics of the operation of the device according to the present invention.

The weight balance machine screw 27 adjusts the hammer weight 14 in such a manner that, if the weight balance machine screw 27 is projected longer below the hammer 13, then the weight imposed on the rear end portion 12 of the key 9 or 10 becomes heavier, while, if the weight balance machine screw 27 is turned so as for it to be projected above the hammer 13, /and so as for the gap between the hammer 13 and the hammer wool cloth 24 of the rear end portion 12 of the key to become narrower, then the weight becomes lighter. The rubber contact characteristics of the silicone rubber material and the hammer spring 19 are as shown in FIG. 7. In this drawing, reference code 36 indicates the characteristics of the elastic portion of the spring, 37 indicates /characteristics of the portion receiving the weight, and 38 indicates the characteristics of the rubber point contact and the spring. The portion of the curve indicated by 39 represents the weight before bending of the point contact rubber made of a silicon rubber, the portion indicated by 40 represents the sound generating portion, and reference code 41 indicates the restoring characteristics.

According to the present invention as described above, the weight of the weight balance machine screw, the elasticity of the spring and the characteristics of the rubber contact are combined together, in such a manner that an after-touch effect should be obtained simultaneously with the contacts to the circuit board.

What is claimed is:

1. A key assembly for an electronic music instrument comprising:

a key;

means for providing a fixed piece carried on a panel;

an integral hammer and hammer beam carried by said means providing a fixed piece, said integral hammer and hammer beam operatively connected to said key; and a spring for resisting movement of said hammer relative to said means for providing a fixed piece, said spring including arms which pivot, one arm of said spring contacting said means for providing a fixed piece and an other arm of said spring contacting said hammer beam, whereby said spring arms transmit a twisting force to said spring which resists movement of said hammer to provide resistance to key movement when said key pushes said hammer.

2. The assembly as defined in claim 1 wherein a spring shaft adapted to carry said spring is carried by said means for providing a fixed piece.

3. The assembly as defined in claim 1 wherein said hammer beam is carried by said panel.

4. A key assembly for an electronic music instrument comprising:

a key;

means for providing a fixed piece carried on a panel, said means including a center pin;

an integral hammer and hammer beam carried by said means for providing a fixed piece, said integral hammer and hammer beam operatively connected to said key;

a spring for resisting movement of said hammer relative to said means for providing a fixed piece, one end of said spring for contacting said means for providing a fixed piece and the other end of said spring for contacting said hammer beam whereby said spring resists movement when said key pushes said hammer; and a hammer guide secured to said panel by a bolt for pivotally securing said hammer beam by means of said center pin.

5. A key assembly for an electronic music instrument comprising:

a key;

means for providing a fixed piece carried on a panel;

an integral hammer and hammer beam carried by said means for providing a fixed piece, said integral hammer and hammer beam operatively connected to said key;

a spring for resisting movement of said hammer relative to said means for providing a fixed piece, one end of said spring for contacting said means for providing a fixed piece and the other end of said spring for contacting said hammer beam whereby said spring resists movement when said key pushes said hammer; and a screw for adjusting the force exerted on said key by said hammer.

6. The assembly as defined in claim 1, further including a point contact pin carried by a lower portion of said key.

7. The assembly as defined in claim 1, further including a support plank and a balance rail secured to a key chassis, said balance rail carrying said key.

8. The assembly as defined in claim 7, further including a pin, said pin carried by said support plank for contacting said key.

9. The assembly as defined in claim 7, further including a balance pin carried by said balance rail and received by said key.

10. The assembly as defined in claim 9, further including a point contact rubber adapted to be inserted into a hole formed on said key chassis below a point contact pin carried by a lower portion of said key.

11. A key assembly for an electronic music instrument comprising:

a key; means for providing a fixed piece carried on a panel;

an integral hammer and hammer beam carried by said means for providing a fixed piece, said integral hammer and hammer beam opratively connected to said key;

a spring for resisting movement of said hammer relative to said means for providing a fixed piece, one end of said spring for contacting said means for providing a fixed piece and the other end of said spring for contacting said hammer beam whereby said spring resists movement of said hammer to provide resistance to key movement when said key pushes said hammer;

a support plank and a balance rail secured to a key chassis, said balance rail carrying said key;

a pin, said pin carried by said support plank for contacting said key; and further including a point contact rubber including insertion protuberances adapted to be inserted into holes of a circuit board, said point contact rubber being integrally formed by a first contact portion, a second contact portion, a bending portion, and a connection rubber plate.

12. The assembly as defined in claim 11, and further including securing pins for securing said circuit board to said key chassis.

13. A key assembly for an electronic music instrument comprising:

a key;

a key chassis coupled to support said key;

a circuit board carried by said key chassis; and a resilient contact adapted to be inserted into a hole formed in said key chassis below said key, said resilient contact including insertion protuberances adapted to be inserted into holes on said circuit board, a first contact portion, a second contact portion, a bending portion, and a connection rubber plate, whereby said contact portions are brought into contact with circuitry on said circuit board when said key is pressed.

14. The assembly as defined in claim 13, and further including securing pins for securing said circuit board to said key chassis.

15. The assembly as defined in claim 13, further including a contact pin carried by said key for making contact with said resilient contact when said key is pressed.

16. The assembly as defined in claim 13 and further including means for providing a fixed piece integral with a panel;

an integral hammer and hammer beam carried by said panel adapted to contact said key; and a spring for resisting movement of said hammer relative to said fixed piece means, one end of said spring for contacting said fixed piece means and the other end of said spring for contacting said hammer beam whereby said spring resists movement of said hammer to provide resistance to key movement when said key pushes said hammer.

17. A key assembly for an electronic music instrument comprising:

a support plank and a balance rail carried by a first key chassis;

a bending piece and a panel integral with a back key chassis;

balance pins carried by said support plank;

a white key and a black key fitted to respective ones of said balance pins;

a point contact pin secured to the lower portions of said white and black keys;

an integral hammer and a hammer beam;

said hammer beam passing through a guide hole carried by said panel;

a hammer guide secured to said panel by a bolt for pivotally securing said hammer beam by means of a center pin;

a spring carried by said guide hole of said panel, one end of said spring adapted to contact said bending piece, the other end of said spring adapted to contact said hammer beam;

a screw carried by said hammer for adjusting the force exerted on the key by said hammer;

a point contact rubber adapted to be inserted into a hole in said key chassis below said point contact pin;

insertion protuberances carried by said point contact rubber adapted to be inserted into holes of a circuit board, said point contact rubber integrally formed by a first contact portion, a second contact portion, a bending portion, and a connection rubber plate, and including securing pins for securing said circuit board to said key chassis.

18. The key assembly as defined in claim 2, further including a spring shaft carried on said means for providing a fixed piece, wherein said spring is carried on said spring shaft whereby said spring twists arounf said spring shaft.

* * * * *

UNITED STATES PATENT AND TRADEMARK OFFICE

CERTIFICATE OF CORRECTION

PATENT NO. : 5,158,003

DATED : October 27, 1992

INVENTOR(S) : Ho J. Lee

It is certified that error appears in the above-identified patent and that said Letters Patent is hereby corrected as shown below:

Column 2, line 34:
"or one" should be --on one--;

Column 2, line 36:
before "of spring 19" insert --arm--;

Column 5, claim 11, line 7:
"opratively" should be --operatively--;

Column 6, line 46, claim 18:
"claim 2 " should be --claim 1--;

Column 6, claim 18, line 49:
"arounf" should be --around--.

Signed and Sealed this

Eighth Day of February, 1994

Bruce Lehman

*Attest:*

BRUCE LEHMAN

*Attesting Officer*

*Commissioner of Patents and Trademarks*